US009128402B2

(12) United States Patent
Uematsu et al.

(10) Patent No.: US 9,128,402 B2
(45) Date of Patent: Sep. 8, 2015

(54) IMAGE FORMING APPARATUS CAPABLE OF EFFECTIVELY PREVENTING IMAGE DENSITY FLUCTUATION

(71) Applicants: Yuuichiroh Uematsu, Kanagawa (JP); Shinichi Akatsu, Kanagawa (JP); Shuji Hirai, Tokyo (JP); Shingo Suzuki, Kanagawa (JP); Tetsuya Muto, Kanagawa (JP); Satoshi Kaneko, Kanagawa (JP); Keita Goto, Kanagawa (JP)

(72) Inventors: Yuuichiroh Uematsu, Kanagawa (JP); Shinichi Akatsu, Kanagawa (JP); Shuji Hirai, Tokyo (JP); Shingo Suzuki, Kanagawa (JP); Tetsuya Muto, Kanagawa (JP); Satoshi Kaneko, Kanagawa (JP); Keita Goto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/105,477

(22) Filed: Dec. 13, 2013

(65) Prior Publication Data

US 2014/0169814 A1 Jun. 19, 2014

(30) Foreign Application Priority Data

Dec. 19, 2012 (JP) ..... 2012-277088

(51) Int. Cl.
*G03G 15/00* (2006.01)
*G03G 15/01* (2006.01)

(52) U.S. Cl.
CPC ..... *G03G 15/0189* (2013.01); *G03G 15/5058* (2013.01); *G03G 2215/0158* (2013.01)

(58) Field of Classification Search
CPC ..... G03G 15/5058; G03G 15/0131; G03G 2215/00042; G03G 2215/00059; G03G 2215/00063; G03G 2215/0177; G03G 2215/0161; G03G 2215/0164; G03G 15/0194; G03G 15/0855; G03G 15/0863; G03G 15/1605
See application file for complete search history.

(56) References Cited

U.S. PATENT DOCUMENTS

| | | | | |
|---|---|---|---|---|
| 2012/0201552 | A1 | 8/2012 | Hirai et al. | |
| 2013/0071131 | A1 * | 3/2013 | Hirabayashi | 399/30 |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |
| 2013/0266331 | A1 * | 10/2013 | Suzuki | 399/49 |

FOREIGN PATENT DOCUMENTS

| | | |
|---|---|---|
| JP | 2011-257497 | 12/2011 |
| JP | 2012-163645 | 8/2012 |

* cited by examiner

*Primary Examiner* — Roy Y Yi
(74) *Attorney, Agent, or Firm* — Oblon, McClelland, Maier & Neustadt, L.L.P.

(57) ABSTRACT

An image forming apparatus includes an image forming unit including rotary members to form a toner image corresponding to image data, in which the image forming unit forms a toner pattern for detecting image density fluctuation; and an image forming condition determination controller to perform image forming processing to ultimately transfer the toner image onto a recording medium. In the image forming apparatus, the controller measures a periodic image density fluctuation occurring in a rotation cycle of the rotary members based on a detection result of a toner pattern; performs image forming condition determination processing to determine an image forming condition to reduce the image density fluctuation based on measured image density fluctuation data; and determines whether or not the image density fluctuation data measured multiple times satisfies a predetermined control termination condition.

16 Claims, 8 Drawing Sheets

IMAGE FORMING APPARATUS CAPABLE OF EFFECTIVELY PREVENTING IMAGE DENSITY FLUCTUATION

CROSS-REFERENCE TO RELATED APPLICATION

The present application claims priority pursuant to 35 U.S.C. §119 from Japanese patent application number 2012-277088, filed on Dec. 19, 2012, the entire disclosure of which is incorporated by reference herein.

BACKGROUND

1. Technical Field

The present invention relates to an image forming apparatus such as a copier, a printer, a facsimile machine, and the like, and in particular relates to an image forming apparatus which forms a toner image corresponding to image data from an image forming unit including a rotary member and transfers the toner image onto a recording medium to obtain a finished image.

2. Related Art

Ever higher image quality continues to be demanded of image forming apparatus employing the electrophotographic method, and in particular preventing image density fluctuation within a single output image or a single page.

In general, image density fluctuation is caused by various factors, from charging to exposure, development, and transfer. Image density fluctuation occurs because the electric field that develops the image between the image carrier and the developer carrier is not constant but instead fluctuates due to the rotary oscillation or sensitivity fluctuation of the image carrier and rotary oscillation of the developer carrier, and consequently, the toner adhesion amount to be adhered on the latent image formed on the image carrier cyclically changes.

A conceivable approach is, for example, to periodically change the image forming conditions such as the developing bias voltage or charging bias voltage to cancel out any periodic fluctuation of the developing electric field, thereby reducing the image density fluctuation that occurs in the rotation cycle of the rotary members such as the image carrier and the developer carrier. For example, the image density fluctuation in the sub-scanning direction occurring in the rotation cycle of the image carrier can be measured in advance by forming a predetermined toner pattern, and the measurement result is stored in a memory so as to correspond to a phase of the image carrier. Then, the image density fluctuation data corresponding to the phase of the image carrier is read in printing the image, and the image forming condition is corrected based on the read data so as to cancel out the image density fluctuation occurring in the rotation cycle of the image carrier.

However, in this method, when the measurement error of the image density fluctuation data is high, the image forming condition capable of appropriately reducing the image density fluctuation that occurs in the rotation cycle of the image carrier cannot be set, and contrarily, the image density fluctuation is aggravated.

JP-2011-257497-A discloses an image forming apparatus capable of remedying the above adverse effect by forming an image for inspection to determine whether or not the banding correction is performed. However, the formation of the special toner pattern for inspection necessarily lengthens the processing time required for improving the image density accuracy and further, more toner needs to be consumed.

SUMMARY

Accordingly, the present invention provides an optimal image forming apparatus capable of avoiding an adverse image density error without providing any special toner pattern additionally. The image forming apparatus includes rotary members to form a toner image corresponding to image data, wherein the image forming unit forms a toner pattern for detecting image density fluctuation, and an image forming condition determination controller performs image forming processing to ultimately transfer the toner image onto a recording medium. The controller measures a periodic image density fluctuation occurring in a rotation cycle of the rotary members based on a detection result of a toner pattern; performs image forming condition determination processing to determine an image forming condition to reduce the image density fluctuation based on measured image density fluctuation data; and determines whether or not the image density fluctuation data measured multiple times satisfies a predetermined control termination condition. If the obtained result does not satisfy the predetermined control termination condition, the image forming processing is performed using the image forming condition determined by the image forming condition determination controller, and if the obtained result satisfies the predetermined control termination condition, the image forming processing is performed without using the image forming condition determined by the image forming condition determination controller.

These and other objects, features, and advantages of the present invention will become apparent upon consideration of the following description of the preferred embodiments of the present invention when taken in conjunction with the accompanying drawings.

DETAILED DESCRIPTION

Hereinafter, a tandem-type color laser copier (or simply "copier") will be described as an image forming apparatus to which the present invention is applied.

Figure 1:
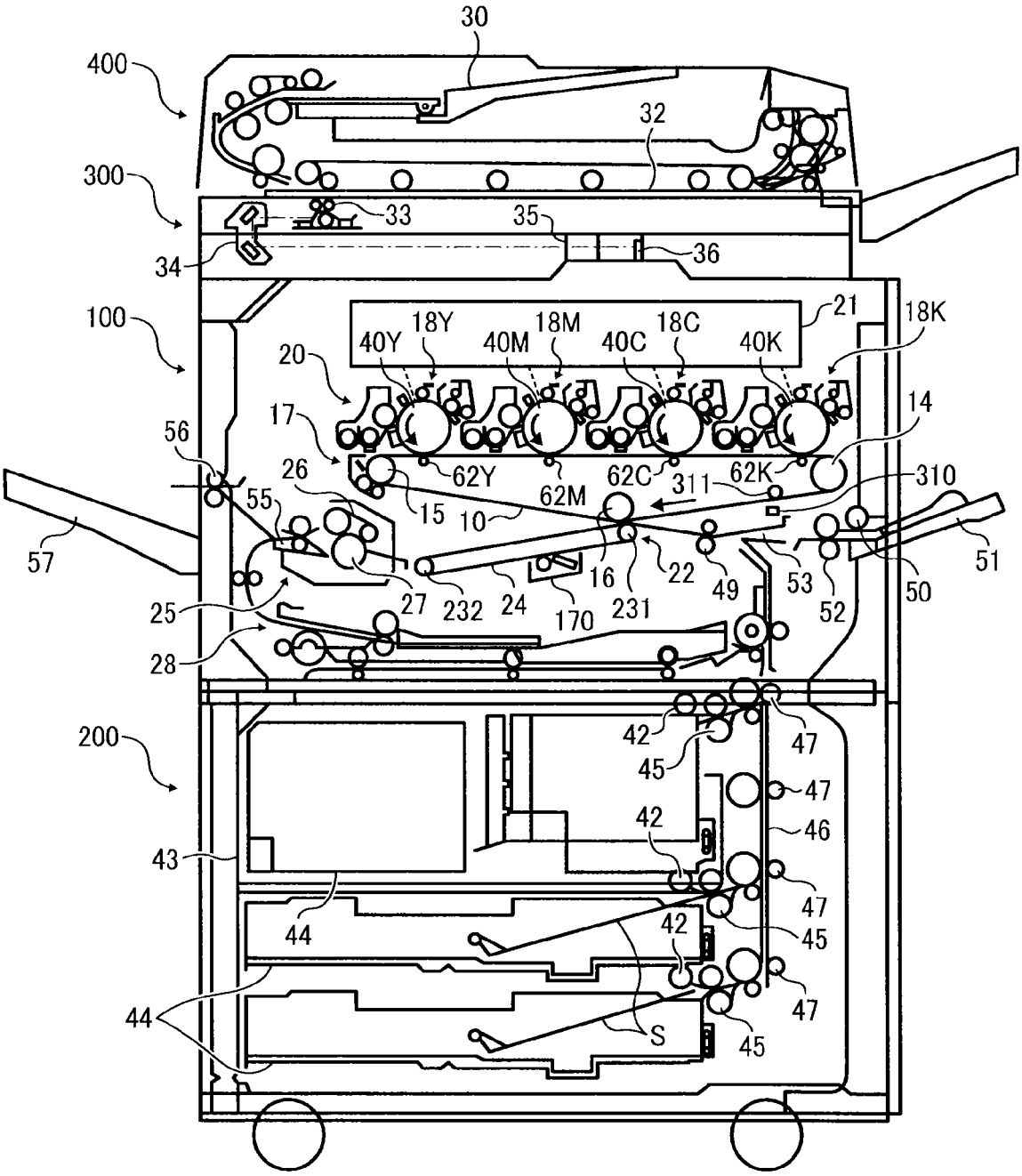
FIG. 1 shows a general configuration of a copier according to an embodiment of the present invention.

FIG. 1 shows a general configuration of a copier according to an embodiment of the present invention.

As illustrated in FIG. 1, the image forming apparatus includes a printer section 100; a sheet feed unit 200 on which the printer section 100 is mounted; a scanner 300 mounted on the printer section 100; and an automatic document feeder (ADF) 400 mounted on the scanner 300. The copier according to the embodiment of the present invention is an electrophotographic copier which adopts the tandem intermediate transfer method or an indirect transfer method.

The printer section 100 includes, in its center thereof, an intermediate transfer belt 10 as an image carrier formed of an endless belt. This intermediate transfer belt 10 is stretched around first to third support rollers 14, 15, and 16, of which a third support roller 16 is a drive roller, and the intermediate transfer belt 10 rotatably moves in the clockwise direction in the figure. In addition, four image forming units each corresponding to one of the colors of Y, M, C, and K are disposed opposite a surface portion of the intermediate transfer belt 10 stretched between the first and second support rollers 14 and 15 among the three support rollers. Specifically, four image forming units 18Y, 18M, 18C, and 18K for yellow (Y), magenta (M), cyan (C) and black (K) are disposed along the belt moving direction so as to form a tandem image forming section 20. An exposure unit 21 as an exposure means is disposed above each of the tandem image forming section 20.

Figure 2:
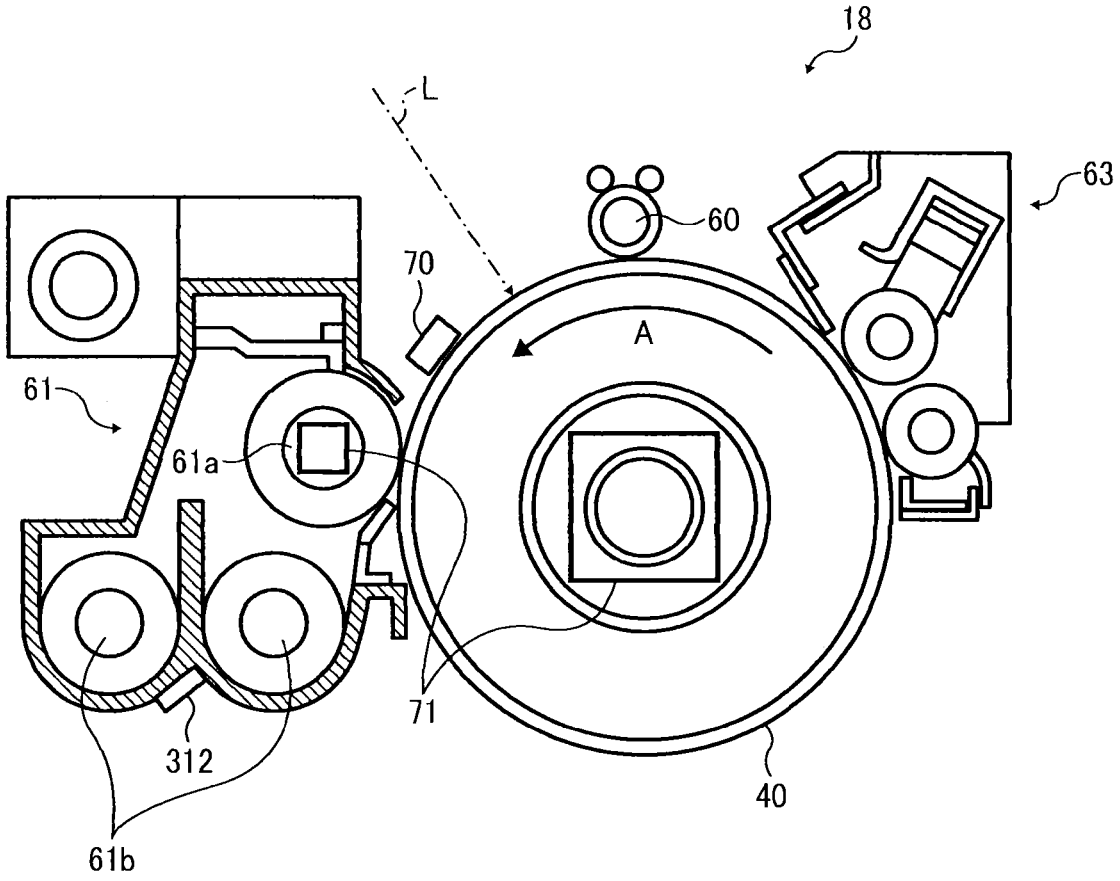
FIG. 2 is an explanatory view of an image forming unit in the copier of FIG. 1.

FIG. 2 illustrates the image forming units 18Y, 18M, 18C, and 18K according to the embodiment of the present invention.

Each of the image forming units 18Y, 18M, 18C, and 18K includes a drum-shaped photoreceptor 40Y, 40M, 40C, or 40K as an image carrier. Around each photoreceptor 40Y, 40M, 40C, or 40K, a charger 60 (which will be described below), a developing device 61, a potential sensor 70 as an electric potential detector, a cleaner, and a discharger are disposed.

Four primary transfer bias rollers 62Y, 62M, 62C, and 62K are so disposed as to contact an inner surface of the intermediate transfer belt 10 disposed opposite the image forming units 18Y, 18M, 18C, and 18K. A primary transfer bias voltage is impressed to the primary transfer bias rollers 62Y, 62M, 62C, and 62K from a power supply, not shown. Each toner image formed on the image forming units 18Y, 18M, 18C, and 18K is sequentially transferred onto the intermediate transfer belt 10 by the primary transfer bias rollers 62Y, 62M, 62C, and 62K. Then, a thus-synthesized color toner image as a superimposed toner image is formed on the intermediate transfer belt 10.

A secondary transfer device 22 as a secondary transfer means is disposed opposite the tandem image forming section 20 with the intermediate transfer belt 10 sandwiched in between. As illustrated in FIG. 1, the secondary transfer device 22 is formed such that an endless secondary transfer belt 24 is stretched around two rollers 231 and 232 and serves to convey a recording medium. The secondary transfer roller 24 is so disposed as to press against the third support roller 16 via the intermediate transfer belt 10. The toner image formed on the intermediate transfer belt 10 is transferred to a sheet S as a recording medium by the secondary transfer device 22.

In addition, a cleaner 17 to remove residual toner remaining on the intermediate transfer belt 10 after image transfer is disposed on the left of the second support roller 15 and downstream of the secondary transfer device 22 in the moving direction of the intermediate transfer belt 10.

In addition, a pair of optical sensors to detect a toner adhesion amount of the toner image on the intermediate transfer belt 10 are disposed downstream of the transfer position by the primary transfer bias rollers 62Y, 62M, 62C, and 62K in the rotation direction of the intermediate transfer belt 10 and upstream of the secondary transfer device 22. More specifically, a reflection-type optical sensor is used as a toner adhesion amount sensor 310. In addition, an optical sensor-opposite roller 311 is disposed at a position opposite the toner adhesion amount sensor 310 with the intermediate transfer belt 10 sandwiched in between.

The fixing device 25 to fix a toner image transferred on the sheet P is disposed on the left of the secondary transfer device 22 in FIG. 1. The fixing device 25 is formed such that a pressure roller 27 is pressed against a fixing belt 26 being an endless belt to be heated. The secondary transfer device 22 includes a function to convey the sheet S on which a toner image has been transferred from the intermediate transfer belt 10 to the fixing device 25. The secondary transfer device 22 can be configured as a transfer roller or a non-contact type transfer charger. In such a case, it is difficult for the secondary transfer device 22 to have a sheet conveyance function. Further, in the present embodiment, a sheet reverse unit 28 to reverse the sheet S to print both sides of the sheet S is disposed in parallel to the tandem image forming section 20 and below the secondary transfer device 22 and the fixing device 25.

When a copy is created using the copier according to the present embodiment, first, a document is set on a document platen 30 of the ADF 400. (Alternatively, the document is set on a contact glass 32 on the scanner 300 after opening the ADF 400 and is pressed by the ADF 400 by closing it.) Thereafter, a start switch is pressed with the document placed on the ADF 400, then, the document is displaced onto the contact glass 32.

On the other hand, when the document is placed directly on the contact glass 32, the scanner 300 is driven immediately. The scanner 300 includes first and second carriers 33 and 34, both of which are driven to move. Then, the first carrier 33 emits light from its light source, receives light reflected from the document surface, and reflects the received light to the second carrier 34. The second carrier 34 reflects the received light via the mirror toward a focusing lens 35 to be incident to a reading sensor 36 which reads content of the document.

In parallel to the document reading, a drive motor rotates the third support roller or the drive roller 16. With this configuration, when the intermediate transfer belt 10 moves in the clockwise direction, the other two support rollers or driven roller 14 and 15 are driven following the movement of the intermediate transfer belt 10.

At the same time, in each of the image forming units 18Y, 18M, 18C, and 18K, the photoreceptor 40Y, 40M, 40C, or 40K rotates. Each surface of the photoreceptors 40Y, 40M, 40C, and 40K is exposed using image information of respective colors of yellow, magenta, cyan, and black, so that each toner image (visible image) of respective colors is formed thereon. Then, the toner images on the photoreceptors 40Y, 40M, 40C, and 40K are sequentially transferred on the intermediate transfer belt 10 to be superimposed on one another and a synthesized color toner image is formed on the intermediate transfer belt 10.

In parallel to such image formation, one of sheet feed roller pairs 42 of the sheet feed device 200 is selectively rotated to feed the sheet S from one of multistage paper trays 44 mounted in a paper bank 43. The fed sheet S is separated from the rest of the stack and inserted into the sheet conveyance path 46, is conveyed by a conveyance roller 47 and introduced into a sheet conveyance path inside the printer section 100, and stops by contacting a registration roller 49. Otherwise, a sheet feed roller 50 is rotated to feed the sheet S on a manual tray 51, the sheet S is separated by a separation roller pair 52 and is introduced into a manual sheet conveyance path 53, and stops by contacting the registration roller pair 49 similarly. Next, the registration roller pair 49 is rotated timed by a synthesized color toner image formed on the intermediate transfer belt 10 so that the sheet S is sent between the intermediate transfer belt 10 and the secondary transfer device 22. Then, the secondary transfer device 22 transfers the synthesized color toner image onto the sheet S.

The sheet P on which the toner image is transferred from the intermediate transfer belt 10 is conveyed into the fixing device 25, in which the transferred toner image on the sheet S is applied with heat and pressure by the fixing belt 26 and the pressure roller 27, so that the transferred toner image is fixed onto the sheet S. Thereafter, the sheet S onto which the transferred toner image has been fixed is switched by the switching claw 55 is discharged by a discharge roller pair 56 and stacked on the sheet ejection tray 57. Alternatively, after the switching claw 55 has switched the direction of the sheet S to be introduced into the sheet reverse unit 28, the sheet S is reversed and is introduced again to the transfer position, and an image is recorded on its backside. Then, the sheet S is ejected on the sheet ejection tray 57 via the ejection roller pair 56.

Then, the intermediate transfer belt 10 after the toner image transfer is cleaned by the intermediate transfer belt cleaner 17. Specifically, the residual toner remaining on the intermediate transfer belt 10 after the image transfer is removed, and the intermediate transfer belt 10 becomes ready for the next image formation by the tandem image forming section 20. Herein, the registration roller pair 49 in general is employed grounded; however, the registration roller pair 49 may be supplied with bias voltage to remove paper dust on the sheet.

When copying an image on a thick sheet, the photoreceptors 40Y, 40M, 40C, and 40K or the intermediate transfer belt 10 may be controlled to be driven by half the speed of the driving speed, i.e., a half-speed mode. Although the order to be driven is the same, the driving speed only becomes half.

Next, as illustrated in FIG. 2, the image forming units 18Y, 18M, 18C, and 18K of the tandem image forming section 20 will be described in detail. In addition, the four image forming units 18Y, 18M, 18C, and 18K are configured similarly to each other except that the color of toner each image forming unit 18Y, 18M, 18C, or 18K handles is different. Therefore, in the description below, suffixes of Y, M, C, and K are omitted.

In image formation, the photoreceptor 40 is driven by a drive motor, not shown, to rotate in Arrow-A direction as illustrated in FIG. 2. Then, the surface of the photoreceptor 40 uniformly charged by the charger 60 is exposed by exposure light L from the exposure unit 21 to write image data of the document copy as described above, and an electrostatic latent image is formed thereon. Color image signals based on the image data from the scanner 300 are subjected to imaging processes such as color conversion by an image controller, not shown, and image signals of each color of Y, M, C, and K are output to the exposure unit 21. The exposure unit 21 converts image signals from the image controller into optical signals and scans while exposing the uniformly-charged surface of the photoreceptor 40, to thereby form an electrostatic latent image.

The developing device 61 includes a developing roller 61*a* as a developer carrier to carry, on its surface, two-component developer formed of toner and carriers installed therein and convey the developer to a position opposed to the photoreceptor 40. The developing roller 61*a* is impressed with developing bias voltage from the power source, not shown, and thus, a development potential being an electric potential is created between the electrostatic latent image on the photoreceptor 40 and the developing roller 61*a*. The development electrical field moves the toner from the developer on the developing roller 61*a* moves on the electrostatic latent image on the photoreceptor 40, that is, the electrostatic latent image is developed and a toner image is formed. The developing device 61 further includes developer conveyance screws 61*b* to convey, while agitating it, the developer installed in the developing device 61. A toner density sensor 312 to detect toner density is disposed in the bottom of one of the developer conveyance screws 61*b* which is farther from the developing roller 61*a*. The toner density sensor 312 is configured to detect toner density as needed.

With the developing device 61, the toner image formed on the photoreceptor 40 is primarily transferred onto the intermediate transfer belt 10 as described above. The surface of the photoreceptor 40 on which the residual toner after the toner image transfer remains is cleaned by the photoreceptor cleaner 63, and is discharged by an electrical discharger, not shown, and is then ready for the next image formation.

In the present embodiment, a rotary position sensor to detect the rotation position of the rotary member such as the photoreceptor 40 or the developing roller 61*a* is disposed. The rotary position sensor of the present embodiment includes a detected member and a photo interrupter 71. The detected member moves cyclically and integrally with the rotation of the photoreceptor 40 or the developing roller 61*a*, and the photointerrupter 71 detects passage of the detected member that passes through the detection area of the photo interrupter 71. Because the rotation position, or phase reference rotation position, of the photoreceptor 40 or the developing roller 61*a* when the detected member passes through the detection area is previously determined, it can be recognized that the rotation position of the photoreceptor 40 or the developing roller 61*a* is positioned at the phase reference rotation position based on when the photo interrupter 71 detects the detected member.

The copier according to the present embodiment includes a full-color mode in which when the full-color image is to be printed, all photoreceptor 40Y, 40M, 40C, and 40K are kept contacting the intermediate transfer belt 10. Further, the copier of the present embodiment includes a monochrome printing mode in which the photoreceptors 40Y, 40M, and 40C other than the photoreceptor 40K are kept separating from the surface of the intermediate transfer belt 10 when printing a monochrome image using black color only. In addition, the copier according to the present embodiment includes an auto color change mode in which the monochrome mode and the full color mode are switched automatically upon detecting whether the document image read by the scanner is the monochrome image or the color image.

Next, a structure and operation related to image forming condition determination processing to determine the image forming condition to reduce the image density fluctuation will be described.

Figure 3:
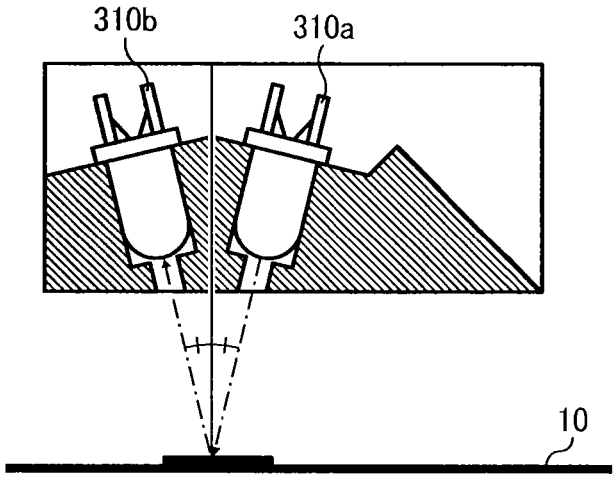
FIG. 3 illustrates a black toner adhesion amount sensor to detect a toner pattern of black (K) color.

FIG. 3 illustrates an example of black toner adhesion amount sensor 310K to detect a toner pattern of the black (K) color.

As illustrated in FIG. 3, the black toner adhesion amount sensor 310K includes a light emitting element 310*a* such as a light emitting element (LED) and a light receiving element 310*b* to receive a specular reflection light. The light emitting element 310*a* radiates light onto the outer circumferential surface of the intermediate transfer belt 10 and the irradiated light is reflected by the intermediate transfer belt 10. The light receiving element 310*b* receives only the specular reflection light among the reflected light.

Figure 4:
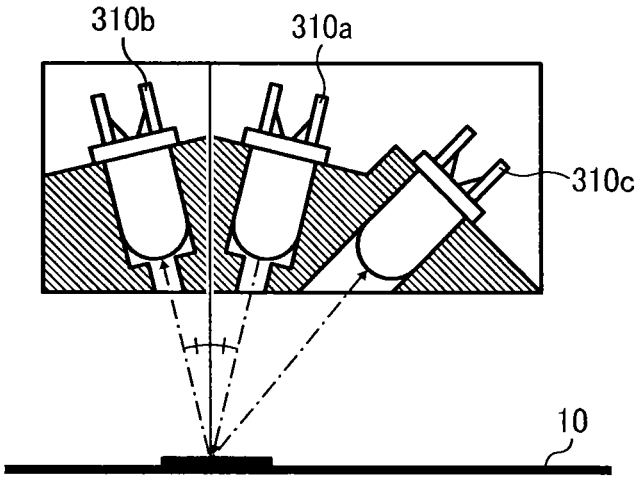
FIG. 4 illustrates a color toner adhesion amount sensor to detect a toner pattern of colors (Y, M, and C) other than black (K) color.

FIG. 4 illustrates the color toner adhesion amount sensor 310Y, 310M, or 310C to detect a toner pattern of colors (Y, M, and C) other than the black (K) color.

As illustrated in FIG. 4, the color toner adhesion amount sensor 310Y, 310M, or 310C includes a light emitting element 310*a* that includes a light emitting element (LED) and the like, a light receiving element 310*b* to receive the specular reflected light, and a light receiving element 310*c* to receive diffused reflection light. The light emitting element 310*a* radiates light onto the outer circumferential surface of the intermediate transfer belt 10 similar to the case of the black toner adhesion amount sensor 310K. The irradiated light is reflected by the surface of the intermediate transfer belt 10. The light receiving element 310*b* that receives only the specular reflected light among the reflected light and the diffused reflected light receiving element 310*c* receives only the diffused light among the reflected light.

In the present embodiment, the light emitting element 310*a* employs a GaAs infrared light emitting diode having a peak wavelength 950 nm of the emitted light and the light receiving elements 310*b* and 310*c* employ a Si photo transistor having a peak light receiving sensitivity of 800 nm. Alternatively, the peak wavelength and the peak light receiving sensitivity may be different from the above values. In addition, the black toner adhesion amount sensor 310K or the color toner adhesion amount sensor 310Y, 310M, or 310C is disposed at a distance of some 5 mm—being a detection distance—from the outer circumferential surface of the intermediate transfer belt 10. In the present embodiment, the toner adhesion amount sensors 310Y, 310M, 310C, and 310K each are disposed in the vicinity of the intermediate transfer belt 10 and image forming conditions are defined based on the detected toner adhesion amount of the toner pattern formed on the intermediate transfer belt 10. Alternatively, the toner pattern for detection can be formed on the photoreceptor 40Y, 40M, 40C, or 40K or the secondary transfer belt 24, so that the toner adhesion amount sensors 310Y, 310M, 310C, and 310K each are configured to detect the toner pattern formed thereon.

Output signals from the toner adhesion amount sensors 310Y, 310M, 310C, and 310K are converted into a toner adhesion amount by a predetermined adhesion amount conversion algorithm, and the toner adhesion amount is sent to a controller, which will be described below.

Figure 5:
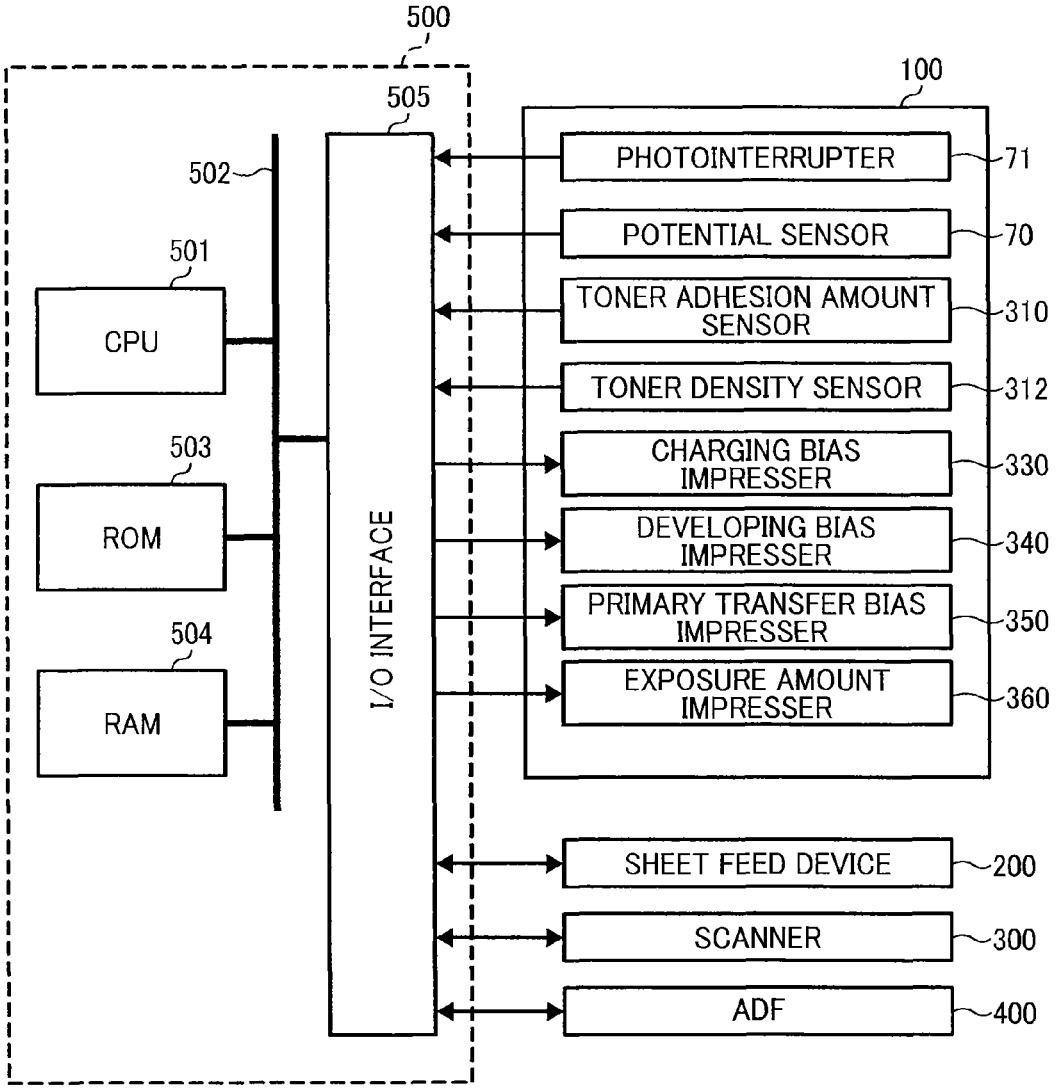
FIG. 5 is a block diagram illustrating an exemplary configuration of a control system of the copier of FIG. 1.

FIG. 5 is a block diagram illustrating an exemplary configuration of a control system of the copier of FIG. 1.

The copier according to the embodiment of the present invention includes a controller 500, implemented by a computing device such as a microcomputer. Alternatively, the controller 500 may be formed of ICs as semiconductor circuit elements created for a controller of the copier according to the present invention.

The controller 500 controls driving of the image forming units 18Y, 18M, 18C, and 18K responsive to the input image data and serves as image quality adjusting means to adjust the quality of output image. The image quality adjustment control according to the present invention includes at least image forming condition determination processing to determine the image forming condition to reduce a periodic image density fluctuation occurring in a rotation cycle of each rotary member including: photoreceptors 40Y, 40M, 40C, and 40K and the developing roller 61*a* of the image forming units 18Y, 18M, 18C, and 18K.

The controller 500 includes, for example, a CPU (central processing unit) 501; a ROM (read only memory) 503 as a memory means connected to the CPU 501 via a bus line 502; a RAM (random access memory) 504, and an I/O interface 505. The CPU 501 causes a control program, a pre-installed computer program, to execute various computation and driving controls on each part and component. The ROM 503 previously stores fixed data such as a computer program or data for the control. The RAM 504 is a rewritable work area to store various data.

Various sensors including the toner adhesion amount sensor 310, a toner density sensor 312, and the potential sensor 70 of the printer section 100 are connected to the controller 500 via the I/O interface 505. Information detected by the various sensors, including the toner adhesion amount sensor 310, the toner density sensor 312, and the potential sensor 70 in the printer section 100, is sent to the controller 500. Further, a charging bias impresser (charging bias power supply) 330 to impress a predetermined charging bias to the charger 60 and a developing bias impresser (developing bias power supply) 340 to impress a predetermined developing bias to the developing roller 61*a* of the developing device 61 are connected to the controller 500 via the I/O interface 505. A primary transfer bias impresser (primary transfer bias power supply) 350 to impress a predetermined primary transfer bias to the primary transfer rollers 62Y, 62M, 62C, and 62K each as a primary transfer device and an exposure impresser (light source power supply) 360 to impress a predetermined voltage to the light source of the exposure unit 21 are connected to the controller 500 via the I/O interface 505. The sheet feed device 200, the scanner 300, and the ADF 400 are connected to the controller 500 via the I/O interface 505. The controller 500 controls each part based on target control values for image forming conditions such as charging bias, developing bias, exposure light amount, and primary transfer bias.

The ROM 503 or the RAM 504 stores a conversion table, not shown, storing information related to the conversion from output values of the toner density sensor 312 to the toner adhesion amount per unit area. In addition, the ROM 503 or the RAM 504 stores target control values for image forming conditions for each image forming unit 18Y, 18M, 18C, or 18K, such as the charging bias, the developing bias, the exposure light amount, and the primary transfer bias.

Figure 6:
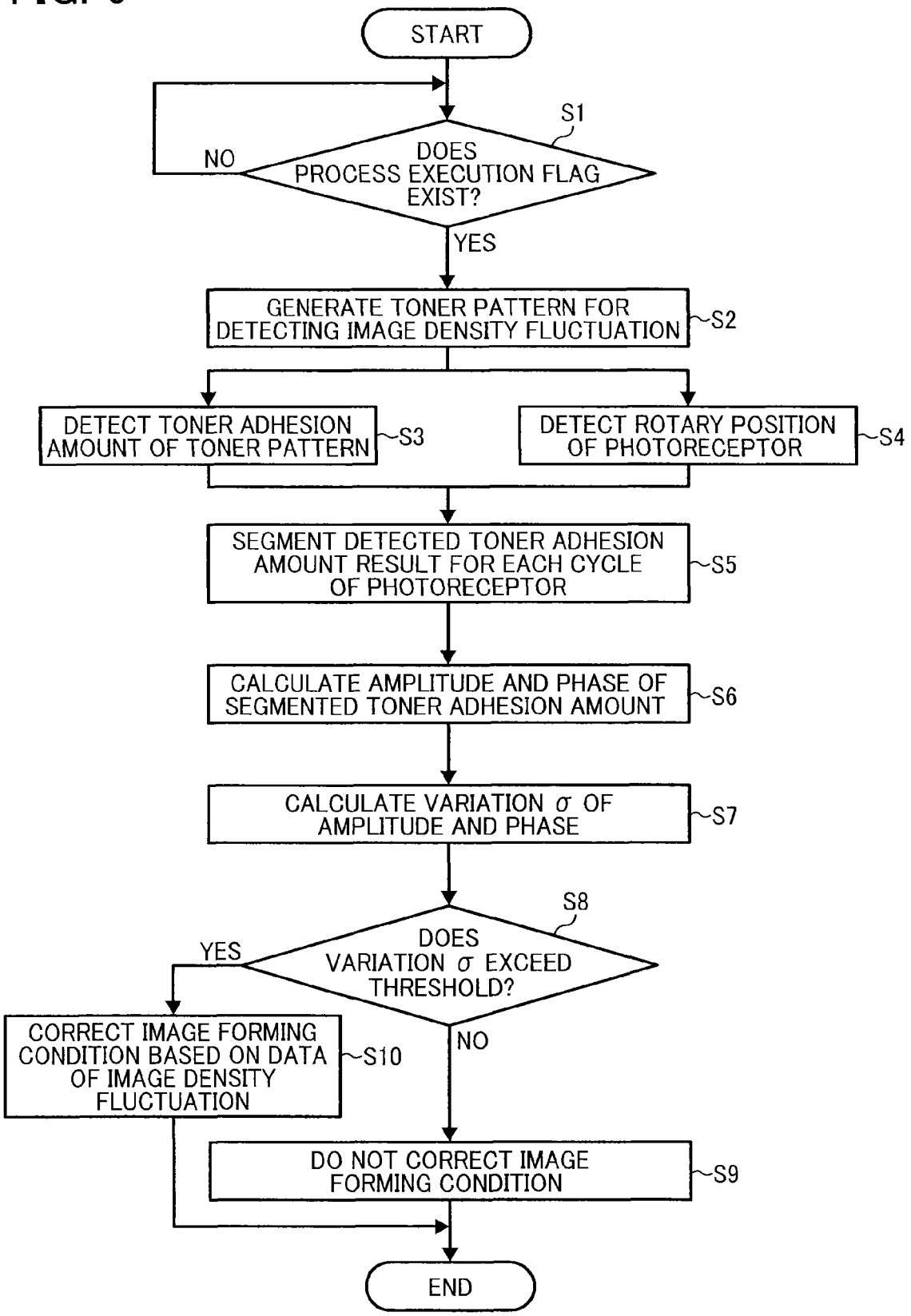
FIG. 6 is a flowchart showing steps in an image forming condition determination process in the embodiment of the present invention.

FIG. 6 is a flowchart showing steps in image forming condition determination processing in the embodiment of the present invention.

Herein, a case in which image density fluctuation in the rotation cycle of the photoreceptor is to be reduced will be described. However, when reducing the periodic image density fluctuation occurring in a rotation cycle of, for example, the developing roller, similar image forming condition determination processing may be performed.

In the image forming condition determination process according to the present embodiment, a previously determined toner pattern for detecting the image density fluctuation is formed on the intermediate transfer belt 10 by each of the image forming units 18Y, 18M, 18C, and 18K, and the thus-formed toner pattern is detected by the toner adhesion amount sensor 310. Thereafter, based on the detection result, periodic image density fluctuation occurring in a rotation cycle of the photoreceptor 40Y, 40M, 40C, or 40K is measured. Then, based on the measured data of the image density fluctuation, the image forming condition to reduce the image density fluctuation is determined.

Specifically, first, when a condition to execute the predetermined image forming condition determination processing is fulfilled, a process execution flag is set (Step S1), and the image forming condition determination process is started. A timing at which this condition is fulfilled, that is, when the process execution flag is set is either: (1) when the photoreceptor is first mounted; (2) a new photoreceptor is mounted in the replacement of the already-mounted photoreceptor; or (3) when the already-mounted photoreceptor is once removed and again mounted. In addition, when the rotation position of the photoreceptor 40Y, 40M, 40C, or 40K detected by the rotary position sensor has changed exceeding a predetermined value or when the detection result of an environment information detection means such as a temperature sensor, not shown, exceeds a predetermined value.

When the process execution flag is set (Yes in S1), first, toner patterns for detecting image density fluctuation are formed on the intermediate transfer belt 10 using all the image forming units 18Y, 18M, 18C, and 18K (Step S2). The toner patterns that the image forming units 18Y, 18M, 18C, and 18K form are band-like solid images having a length in the sub-scanning direction longer than at least the perimeter of the photoreceptor 40. In the present embodiment, the length in the sub-scanning direction of each color toner pattern TPY, TPM, TPC, or TPK is set to more than double the perimeter of the photoreceptor.

Figure 7:
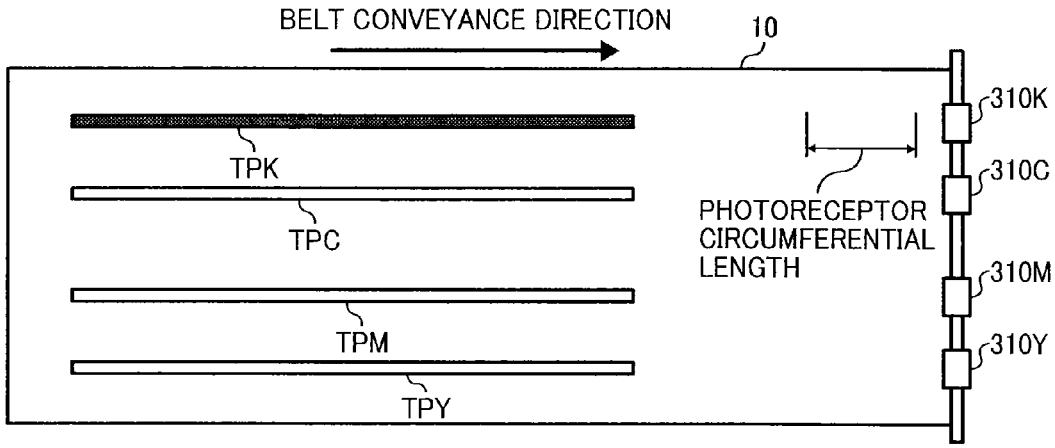
FIG. 7 illustrates how to detect a toner pattern of each color by different toner adhesion amount sensors.
Figure 8:
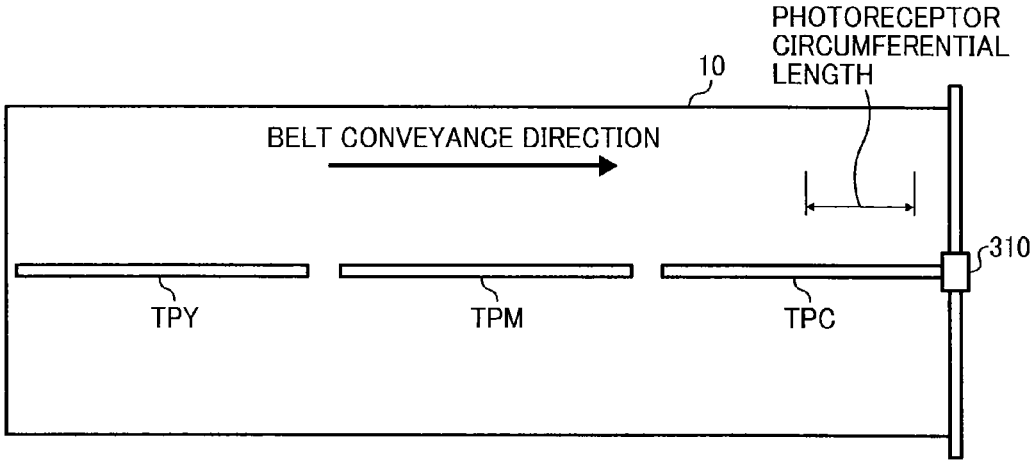
FIG. 8 illustrates how to detect a toner pattern of each color with a single toner adhesion amount sensor.

As illustrated in FIG. 7, in the present embodiment, different toner adhesion amount sensors 310Y, 310M, 310C, and 310K for respective colors are provided along the main scanning direction, so that each color toner pattern TPY, TPM, TPC, or TPK can be detected in parallel. Accordingly, compared to a case in which a single toner adhesion amount sensor 310 sequentially detects each color toner pattern TPY, TPM, TPC, or TPK as illustrated in FIG. 8, the time required to form and detect the toner pattern can be reduced. However, because the number of the toner adhesion amount sensors 310 is not less than four, the structure as illustrated in FIG. 8 is less costly.

The toner adhesion amount sensors 310Y, 310M, 310C, and 310K detect continuously the toner adhesion amount of each color toner pattern TPY, TPM, TPC, or TPK at a predetermined sampling time interval (Step S3). Each color toner pattern TPY, TPM, TPC, or TPK is formed as a uniformly solid image from a leading end to a trailing end in the sub-scanning direction. However, if the photoreceptor 40Y, 40M, 40C, or 40K fluctuates in the rotary movement or sensitivity fluctuation in the sub-scanning direction exists for the photoreceptor, a periodic image density fluctuation appears in the rotation cycle of the photoreceptor. The image density fluctuation can be obtained from the detection result of the toner adhesion amount sensors 310Y, 310M, 310C, and 310K.

Otherwise, in parallel to the toner adhesion amount detection of the toner pattern TPY, TPM, TPC, and TPK, a rotary position or the phase reference rotation position of each photoreceptor 40Y, 40M, 40C, or 40K is detected by the photointerrupter 71Y, 71M, 71C, and 71K (Step S40).

Figure 9:
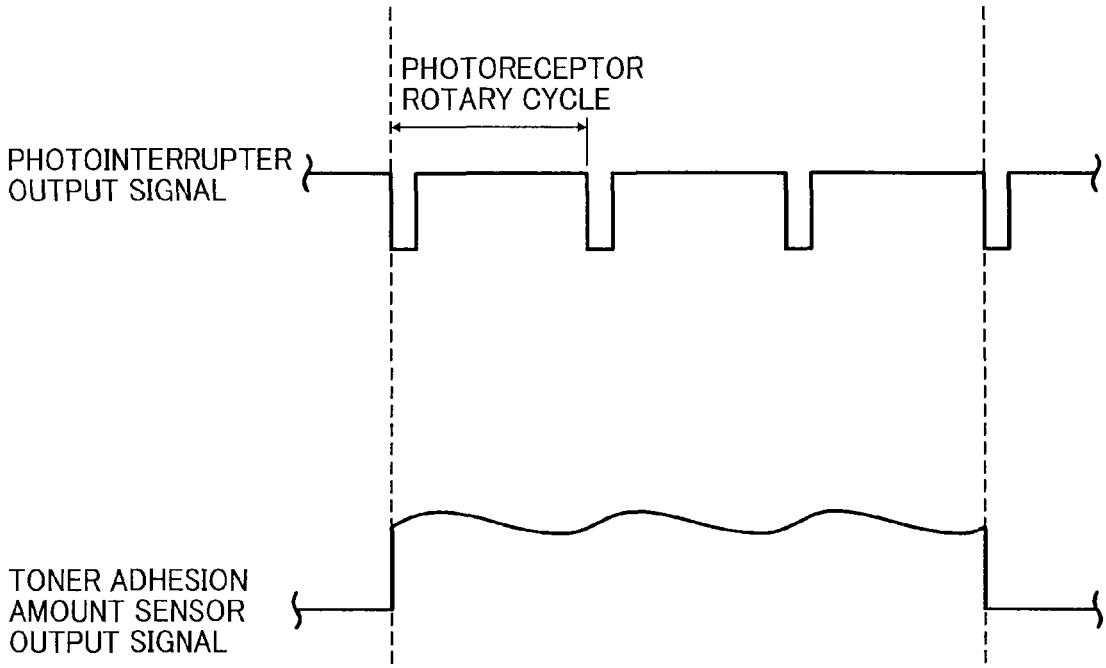
FIG. 9 illustrates a relation between output signals from the toner adhesion amount sensor to detect the toner pattern and from a photointerrupter to detect a rotary position of a photoreceptor.

FIG. 9 illustrates a relation between output signals from the toner adhesion amount sensor 310 to detect the toner pattern and from the photointerrupter 71 to detect a rotary position of the photoreceptor 40.

The graph shows, as an example, signals of three cycles of the circumferential length of the photoreceptor. As illustrated in FIG. 9, the output signal of the toner adhesion amount sensor 310 changes at the same cycle with that of the output signal of the photointerrupter 71. Herein, the image density fluctuation according to the rotary cycle of the photoreceptor is exemplified; however, the image density fluctuation according to the rotary cycle of other rotary member such as the developing roller 61*a* would be the same.

In the present embodiment, the image density fluctuation data of the toner patterns TPY, TPM, TPC, and TPK detected by the toner adhesion amount sensors 310Y, 310M, 310C, and 310K and the rotary position data of the photoreceptors 40Y, 40M, 40C, and 40K detected by the photointerrupters 71Y, 71M, 71C, and 71K are sent to the controller 500. The controller 500 divides the image density fluctuation data (or the toner adhesion amount detection result) by each cycle of the photoreceptor using the information on the rotation position of the photoreceptor (Step S5). Specifically, as illustrated in FIG. 9, based on the time when the output signal of the photointerrupter 71 falls, signals corresponding to the period of time of one cycle of the photoreceptor are taken out, thereby obtaining three cycles of information of the image density fluctuation of the circumferential length of the photoreceptor.

Figure 10:
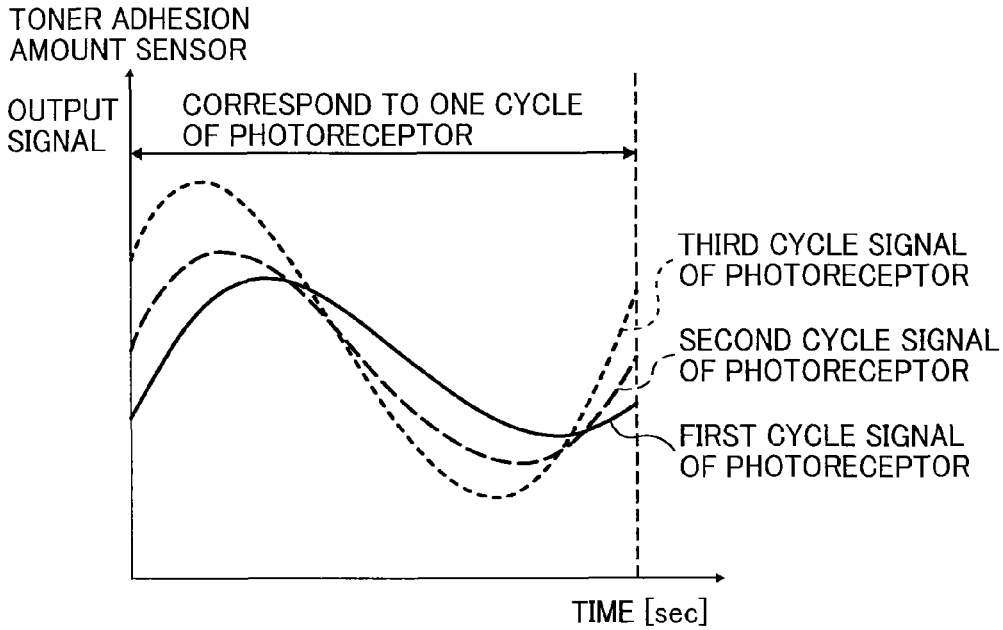
FIG. 10 is a graph illustrating different image density fluctuations of a first cycle to a third cycle due to measurement error.

The thus-obtained multiple cycles of image density fluctuation data include measurement errors due to various factors as illustrated in FIG. 10, and the phase or the amplitude in the image density fluctuation data in each cycle is not coincident. The controller 500 calculates each amplitude A1, A2, or A3 and phase θ1, θ2, or θ3 for the image density fluctuation data (or the toner adhesion amount detection result) divided by each cycle of the photoreceptor (Step S6). The calculations may be performed by using orthogonal wave detection processing or fast Fourier transformation (FFT) processing.

The controller 500 stores the obtained data including amplitudes A1, A2, A3, . . . , and phases θ1, θ2, θ3, . . . corresponding to multiple cycles as image density fluctuation data in the RAM 504. Then, the controller 500 calculates a variation σ1 among the amplitudes A1, A2, A3, . . . and a variation σ2 among the phases θ1, θ2, θ3, . . . of the multiple cycles, respectively (Step S7).

In the example as illustrated in FIG. 7, the image density fluctuation data for one rotary cycle of the photoreceptor is set as one measurement unit, and variations of σ1 and σ2 of the image density fluctuation data (i.e., the amplitude and the phase data) measured three times are to be calculated; however, the image density fluctuation data corresponding to the multiple cycles is set as one measurement unit and variations may be calculated from the image density fluctuation data measured multiple times. For example, from the toner adhesion amount detection result of the first to third photoreceptor cycles, a first set of amplitude data A1 and phase data θ1 is calculated by direct wave detection processing. Similarly, from the toner adhesion amount detection result of the fourth to sixth cycles of the photoreceptor, a second set of amplitude data A2 and phase data θ2 is calculated, and the above calculation operation is repeated so that multiple image density fluctuation data (A1, A2, A3, . . . , θ1, θ2, θ3, . . . ) can be obtained. In this case, the image density fluctuation data with higher precision can be obtained. However, because the sub-scan length of the toner pattern needs to be extended, it is not preferable due to the prolonged processing time and increased consumed toner amount.

As the image density fluctuation data, output signals of the toner adhesion amount sensor 310 may be used, and alternatively, the data converted into the toner adhesion amount from the output signals of the toner adhesion amount sensor 310 can be used.

The variation σ1 among amplitude data A1, A2, A3, . . . , of multiple cycles can be defined as follows: For example, difference between each amplitude data (|A1−A2|, |A1−A3|, |A2−A3|, . . . ) is calculated, and the maximum value can be defined as a variation σ1. Otherwise, for example, deviation from an average value of the amplitude data, or dispersion or standard deviation can be used as the variation σ1. As to the variation σ2 among phase data θ1, θ2, θ3, . . . , of multiple cycles, the same definition can be used.

The controller 500 compares the thus-obtained variations σ1 and σ2 with preset thresholds (Step S8). Then, if both the variation al of the amplitude and the variation σ2 of the phase are below each corresponding threshold (No in Step S8), image forming condition determination processing to correct the image forming condition is performed using the image density fluctuation data (Step S9). On the other hand, if either of the variation al in the amplitude data or the variation σ2 in the phase data exceeds each corresponding threshold (Yes in Step S8), image forming condition determination processing is stopped (Step S10). In this case, the image forming condition determination process is not performed this time, and the image forming processing is performed under the previous image forming condition.

Next, details of the image forming condition determination process will be described.

Figure 11:
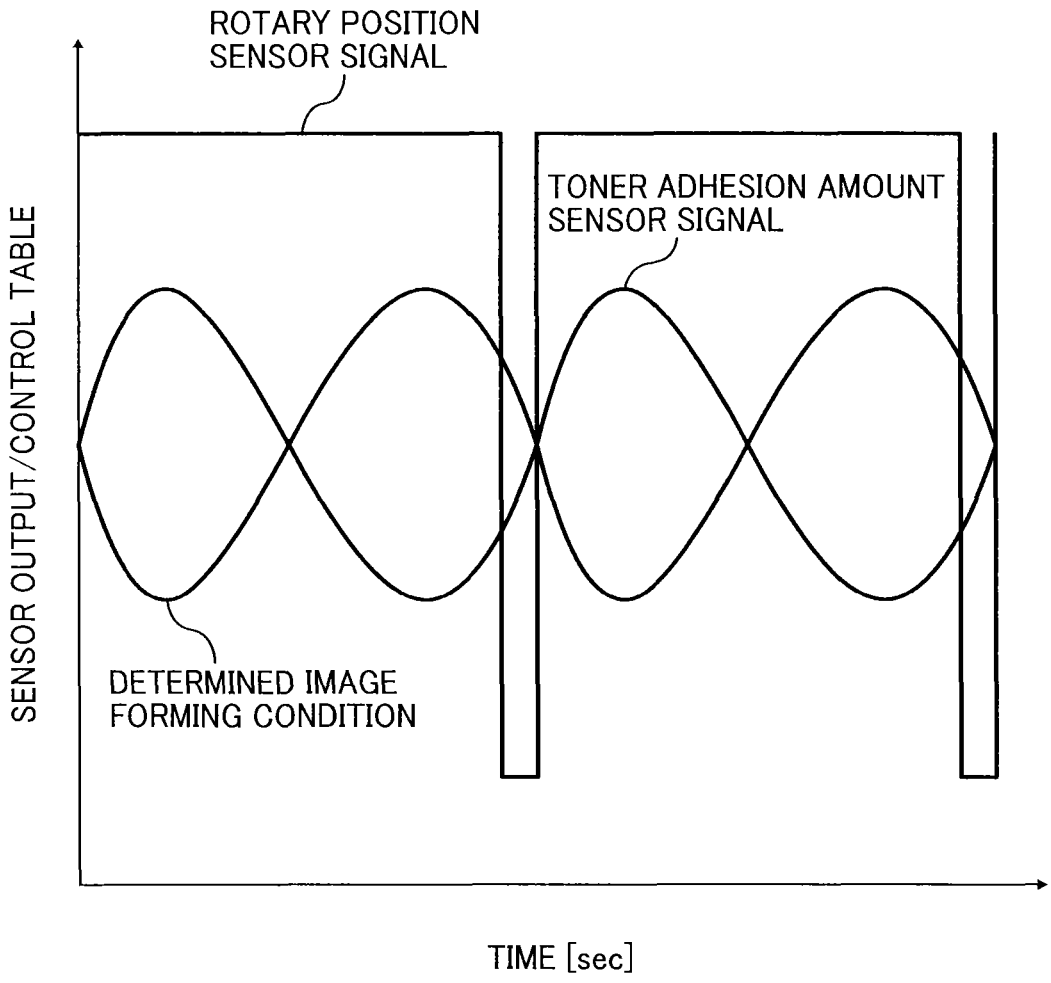
FIG. 11 illustrates a relation among a rotary position detection signal when the toner pattern is formed, a toner adhesion amount detection signal, and an image forming condition determined by an image density fluctuation reducing control.

FIG. 11 illustrates relations among output signals (that is, the rotary position detection signal) from the photointerrupter 71 showing a rotary position of the photoreceptor when the toner pattern for detecting the image density fluctuation is formed; the toner adhesion amount detection result of the toner pattern (that is, the toner adhesion amount detection signal); and the image forming condition (or the control table) determined by the image forming condition determination process. FIG. 11 shows an exemplary relation as to two cycles of the photoreceptor.

As illustrated in FIG. 11, the toner adhesion amount detection signal changes at the same cycle with the cycle of the rotary position detection signal. In the image forming condition determination process according to the present embodiment, the image forming condition (that is, the control table) having a phase opposite the toner adhesion amount detection signal is determined based on the toner adhesion amount detection signal (that is, the image density fluctuation data). Herein, there is a case in which the expression of "opposite phase" is not appropriate because the development bias or the exposure power, which are used as the first condition for the image density control parameter, and the charging bias used as the second condition for the image density control parameter may include a – (minus) code or may have a reduced adhering amount with a high absolute value. However, the expression of "opposite phase" is used in a meaning that a control table to cancel the adhering amount variation as represented by the toner adhesion amount detection signal is to be created, that is, a control table with a reverse phase is to be created.

A gain is a fluctuation amount of the control table in determining the control table with respect to the fluctuation amount [V] of the toner adhesion amount detection signal and corresponds to each adjustment gain, which will be described later. The gain can be principally obtained from theory, but is verified in an actual experiment based on the theoretical value and is obtained ultimately from the experimental data. In actuality, a final gain is preferably determined from experimental data verified in an actual copier from the theoretical value. The control table is created using the thus-determined gain and has a timed relation as illustrated in FIG. 11 with the rotary position detection signal.

In the illustrated example, a leading end of the control table corresponds to an occurrence of the rotary position detection signal. If the control table is, for example, the developing bias control table, a timing to apply the control table is determined considering the distance where the toner image moves between the development area to an area at which the toner adhesion amount sensor 310 detects. If such a distance from the developing area to the detection area of the toner adhesion amount sensor 310 is just an integer multiple of the circumferential length of the photoreceptor, the control table can be applied from a leading end in sync with the rotary position detection signal. If the toner image moving distance from the developing area to the detection area by the toner adhesion amount sensor 310 is not an integer multiple of the circumferential length of the photoreceptor, the control table can be applied by shifting a time period by a shifted distance.

The image forming condition determined by the image forming condition determination process may not be a developing bias, but an exposure power or a charging bias. When the exposure power is to be controlled, the exposure power control table so as to cancel the toner adhesion amount fluctuation that the toner adhesion amount detection signal shows by the image forming condition determination process is created, and the timing to apply the control table is determined considering the image moving distance from the exposure position to the detection area by the toner adhesion amount sensor 310. Similarly, when the charging bias is to be controlled, the charging bias control table so as to cancel the toner adhesion amount fluctuation that the toner adhesion amount detection signal shows via the image forming condition determination process is created, and the timing to apply the control table is determined considering the image moving distance from the charging position to the detection area by the toner adhesion amount sensor 310.

As described above, in the present embodiment, the image forming condition determination process is executed (1) at an initially set timing when the photoreceptor is first mounted; (2) a new photoreceptor is mounted in replacement of the already-mounted photoreceptor; or (3) when the already-mounted photoreceptor is once removed and again mounted. This is because, when the photoreceptor 40 is newly mounted, there is a high possibility that the image density fluctuation of the previous photoreceptor cycle changes. In addition, because the relative positions of the photoreceptor as a detected member before being mounted and the photointerrupter 71 changes. In addition, when initially setting the photoreceptor for which the control table is not prepared yet, the control table needs to be generated by performing the image forming condition determination process. When the photoreceptor is replaced, a new control table needs to be produced for a new photoreceptor because there is a difference between the old and new photoreceptors such as a rotary oscillation and sensitivity fluctuation. Further, even when the photoreceptor is simply disengaged for the maintenance, the control table needs to be reproduced because there is a possibility that the mounting status of the photoreceptor due to the disengagement of the photoreceptor changes and that the axis of the photoreceptor and the rotary axis deviate each other. In addition, the control table needs to be reproduced because there is a difference in the positional or phase relation between the position of the photoreceptor related to a rotation characteristic and photosensitivity fluctuation and the photointerrupter 71.

Due to above reasons, the image forming condition determination process needs to be performed immediately after the photoreceptor is mounted. In the image forming condition determination process, as described above, the image density fluctuation is measured and the image forming condition (or the control table) is so determined as to cancel the image density fluctuation. However, if the measurement error in the image density fluctuation data is large, which may increase the image density fluctuation. For example, when the measurement error of the phase data related to the measured image density fluctuation data is 180 degrees and the control table is produced based on the measured image density fluctuation data, assume that the image forming condition such as the developing bias is controlled using the produced control table. Then, the toner is adhered more in a portion where the toner adhesion amount is high, and the toner adhesion amount is reduced more to a portion where the toner adhesion amount is less, resulting in larger image density fluctuation.

In the present embodiment, as described above, when variations σ1, σ2 in the image density fluctuation data measured multiple times exceed the thresholds, image forming condition determination processing is stopped (Yes in Step S8). Magnitude of the measurement error included in the image density fluctuation data (A1, A2, A3, . . . , θ1, θ2, θ3, . . . ) has a high correlation with the variations σ1, σ2 of the measurement error included in the multiple image density fluctuation data (A1, A2, A3, . . . , θ1, θ2, θ3, . . . ). If the variations σ1, σ2 of the image density fluctuation data (A1, A2, A3, . . . , θ1, θ2, θ3, . . . ) are large, the measurement error includes in the image density fluctuation data is also possibly high. According to the present embodiment, the image forming condition is not determined based on the image density fluctuation data with the high measurement error, thereby preventing such an event from occurring in which the image density fluctuation is further degraded due to the image forming control based on the image density fluctuation data with the high measurement error.

It is preferred that the image forming condition determination process be performed when the environmental condition such as temperature or humidity inside the copier changes more than the prescribed range. In particular, when the temperature inside the copier changes exceeding the predetermined range, the photoreceptor core tube expands or contracts corresponding to the thermal expansion coefficient of the photoreceptor core tube. As a result, an external profile of the photoreceptor changes, the development gap fluctuation status changes, and the occurrence status of the image density fluctuation may change. To cope with this change, the image forming condition determination process is performed at a timing at which the detection result of environmental information detection means such as a temperature sensor, not shown, changes more than the predetermined value, the image forming condition determination process is performed and the control table to reduce the image density fluctuation is to be produced. Specifically, for example, if the temperature in the image forming condition determination process at the current time is changed by more than N degrees from the image forming condition determination process in the previous time, the image forming condition determination process is set to be performed.

As described above, the image density fluctuation of the developing roller rotation cycle can be reduced by obtaining the image density fluctuation data of the developing roller rotation cycle in addition to the image density fluctuation data of the photoreceptor rotation cycle. The image density fluctuation of the developing roller rotation cycle has a shorter cycle and smaller amplitude compared to that of the photoreceptor rotation cycle. As a result, even though the image density fluctuation data as the detection result of the toner adhesion amount is segmented by the rotary cycle of the developing roller, the image density fluctuation of the developing roller rotation cycle is obscured by the image density fluctuation of the photoreceptor rotation cycle and the measurement error of the image density fluctuation data of the developing roller rotation cycle may be increased. In such a case, when the image density fluctuation data of the developing roller rotation cycle is measured, it can be configured such that, first, a fluctuation component of the photoreceptor rotation cycle is removed, and then, the image density fluctuation data of the developing roller rotation cycle can be detected.

The aforementioned embodiments are examples and specific effects can be obtained for each of the following aspects of (A) to (M):

Aspect A: The image forming apparatus has an image formation control means such as a controller 500 to perform image forming processing, in which the image forming unit 18 including rotary members such as the photoreceptor 40 and the developing roller 61*a* forms a toner image corresponding to image data, and the toner image is ultimately transferred onto the recording medium such as the sheet S. The image forming unit 18 forms the toner pattern TP for detecting the image density fluctuation. The periodic image density fluctuation data (i.e., amplitude data A1, A2, A3, . . . , and phase data θ1, θ2, θ3, . . . ) occurring in the rotation cycle of the above rotary members based on the detection result of the toner pattern TP are measured. The controller 500 serves as the image forming condition control means to perform image forming condition determination processing for determining the image forming condition such as the developing bias to reduce the image density fluctuation based on the measured image density fluctuation data. The image forming controller determines whether the variations σ1 and σ2 of the image density fluctuation data measured multiple times satisfy the predetermined control termination condition. If the obtained result does not satisfy the predetermined control termination condition, the image forming processing is performed using the image forming condition determined by the image forming condition determination controller, and if the obtained result satisfies the predetermined control termination condition, the image forming processing is performed without using the image forming condition determined by the image forming condition determination controller.

With this configuration, determination whether the image forming processing is performed using the image forming condition obtained by the image forming condition determination controller in order to reduce the image density fluctuation can be performed based on the variations σ1 and σ2 of the toner pattern TP for detecting the image density fluctuation that the image forming condition determination controller employs for determining the image forming condition. According to the present embodiment, the image forming condition is not determined based on the image density fluctuation data with the high measurement error, thereby preventing such an event from occurring in which the image density fluctuation is further degraded due to the image forming control based on the image density fluctuation data with the high measurement error. Because variations σ1 and σ2 of the toner pattern TP for detecting the image density fluctuation has a high correlation with the measurement error included in the image density fluctuation data (A1, A2, A3, . . . , θ1, θ2, θ3, . . . ), any event to unexpectedly increase the image density fluctuation by performing the image forming processing using the image forming condition determined based on the image density fluctuation data having a high measurement error is prevented. Further, according to the present embodiment, the toner pattern need not be formed additionally for the determination of termination or continuation, whereby no problem occurs such as an increased processing time or consumed toner amount due to the formation of dedicated use of toner patterns.

Aspect B: In the above aspect A, the image forming unit 18 forms a toner image corresponding to the image information on the image carrier such as the photoreceptor 40 being a rotary member. The image density fluctuation data cyclically occurring by the rotary cycle of the image carrier includes at least one of the information of the amplitude A1, A2, A3, . . . , and the phase θ1, θ2, θ3, . . . .

As a result, a periodic image density fluctuation occurring in the rotation cycle of the image carrier can be appropriately reduced.

Aspect C: In the above aspects A and B, the image forming unit 18 forms a toner image by developing, with toner carried by the developer carrier such as a developing roller 61*a* as a rotary member, a latent image formed on the image carrier such as a photoreceptor 40 corresponding to the image information, and the information on the image density fluctuation includes at least amplitude information or phase information of the periodic image density fluctuation occurring by the rotary cycle of the developer carrier.

As a result, a periodic image density fluctuation occurring in the rotation cycle of the image carrier can be appropriately reduced.

Aspect D: In any of the above aspects A to C, the image density fluctuation data corresponds to the image density fluctuation data of one rotation cycle of the rotary member.

As a result, the measurement time of the image density fluctuation data is short and the toner consumption amount can be restricted.

Aspect E: In any of the above aspects A to C, the image density fluctuation data corresponds to the image density fluctuation data of multiple rotary cycles of the rotary member.

In this case, the image density fluctuation data can be obtained with higher precision.

Aspect F: In any of the above aspects A to E, the predetermined control termination condition is that the variation indices σ1 and σ2 of the multiple-times measured image density fluctuation data exceed the predetermined threshold.

Accordingly, the image forming condition is not determined based on the image density fluctuation data with the high measurement error, thereby preventing such an event from occurring in which the image density fluctuation is further degraded due to the image forming control based on the image density fluctuation data with the high measurement error.

Aspect G: In the above aspect A, the length of the toner pattern for detecting the image density fluctuation in the direction corresponding to the rotation direction of the rotary member is more than double the perimeter of the rotary member.

In this case, multiple image density fluctuation data can be obtained continuously from one toner pattern, thereby reducing the processing time.

Aspect H: In any of the above aspects A to G, the toner pattern TP for detecting the image density fluctuation is formed by the image forming condition with the same toner adhesion amount.

In this case, the image density fluctuation data can be obtained easily.

Aspect I: In any of the above aspects A to H, the image forming unit 18 includes a charger 60, a charging means to charge the image carrier such as the photoreceptor 40, an exposure means such as the exposure unit 21 to expose the charged surface of the image carrier corresponding to the image information, a developing means to develop the latent image formed on the image carrier by exposure of the light with toner on the developer carrier such as the developing roller 61*a*, a transfer means such as a primary transfer device or roller 62 to transfer the toner image formed on the image carrier by the development, to the transfer target member such as the intermediate transfer belt 10. The image forming condition includes at least charging condition, development condition, exposure condition, and transfer condition in the image forming unit.

As a result, the image density fluctuation in the output image can be appropriately eliminated.

Aspect J: In any of the above aspects A to I, the image forming apparatus includes a rotary position sensor such as a photointerrupter 1 to detect a rotary position of the rotary member and the image forming controller performs image forming process using the image forming condition determined by the image forming condition determination controller in synchronization with the rotary position of the rotary member detected by the rotary position sensor.

As a result, the image density fluctuation in the output image can be appropriately eliminated.

Aspect K: In any of the above aspects A to J, the image forming apparatus includes a rotary position sensor such as a photointerrupter 71 to detect a rotary position of the rotary member and the image forming controller determines whether or not the predetermined control termination condition is satisfied when the rotation position detected by the rotary position sensor has changed more than a predetermined threshold.

When the rotation position of the rotary member changes greatly, the phase relation between the image density fluctuation and the image forming condition breaks up and the image density fluctuation of the output image may not be eliminated appropriately. According to the present embodiment, in such a case, determination whether or not the control to reduce the image density fluctuation is terminated or not is performed, thereby restricting occurrence of the event in which the image density fluctuation adversely increases by performing the image density fluctuation reducing control.

Aspect L: In any of the above aspects A to K, the image forming controller determines whether or not the predetermined control termination condition is satisfied when the rotary member is mounted to the apparatus.

The image density fluctuation occurring condition changes at the time of initial setting of the rotary member, replacement or detachment thereof, and the image forming condition in which the image density fluctuation data is to be reduced may not eliminate the image density fluctuation appropriately. According to the present embodiment, in such an occasion, determination whether or not the image density fluctuation reducing control is suspended is performed, thereby preventing occurrence of the event in which the image density fluctuation is increased unexpectedly by the execution of the image density fluctuation reducing control.

Aspect M: In any of the above aspects A to L, the image forming apparatus includes at least an environmental information detection means such as a temperature sensor to detect environmental information including the temperature information, and the image forming controller determines whether or not the predetermined control termination condition is satisfied when the environmental information detected by the environmental information detector changes more than the threshold value.

When the environmental information greatly changes, a state of occurrence of the image density fluctuation changes, and the image density fluctuation may not be eliminated appropriately by the image forming condition previously set for reducing the image density fluctuation data. According to the present embodiment, in such an occasion, determination whether or not the image density fluctuation reducing control is suspended is performed, thereby preventing occurrence of the event in which the image density fluctuation is increased unexpectedly by the execution of the image density fluctuation reducing control.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image forming unit comprising rotary members, including an image carrier and a developer carrier, to form a toner image corresponding to image data, wherein the image forming unit forms a toner pattern for detecting image density fluctuation; and an image forming condition determination controller to perform image forming processing to ultimately transfer the toner image onto a recording medium, wherein the image forming condition determination controller is configured to:

measure a periodic image density fluctuation occurring in a rotation cycle of the rotary members based on a detection result of the toner pattern;

perform image forming condition determination processing to determine an image forming condition to reduce the image density fluctuation based on measured image density fluctuation data; and determine whether or not the image density fluctuation data measured multiple times satisfies a predetermined control termination condition, wherein, if an obtained result does not satisfy the predetermined control termination condition, the image forming processing is performed using the image forming condition determined by the image forming condition determination controller, and if the obtained result satisfies the predetermined control termination condition, the image forming processing is performed without using the image forming condition determined by the image forming condition determination controller.

2. The image forming apparatus as claimed in claim 1, wherein the image density fluctuation data cyclically occurring in the rotation cycle of the image carrier includes at least one of an amplitude and a phase.

3. The image forming apparatus as claimed in claim 1, wherein:

the image forming unit forms a toner image by developing a latent image formed on the image carrier corresponding to the image data with toner carried on the developer carrier, and information on the image density fluctuation includes at least one of an amplitude and a phase of the periodic image density fluctuation occurring in the rotation cycle of the developer carrier.

4. The image forming apparatus as claimed in claim 1, wherein the image density fluctuation data corresponds to the image density fluctuation data of one rotation cycle of a rotary member.

5. The image forming apparatus as claimed in claim 1, wherein the image density fluctuation data corresponds to the image density fluctuation data of multiple rotation cycles of the rotary members.

6. The image forming apparatus as claimed in claim 1, wherein the predetermined control termination condition is satisfied when variation indices of the image density fluctuation data measured multiple times exceed a predetermined threshold.

7. The image forming apparatus as claimed in claim 6, wherein a length of the toner pattern for detecting the image density fluctuation in a direction corresponding to a rotation direction of the rotary member is more than double a circumference of the rotary member.

8. The image forming apparatus as claimed in claim 1, wherein the toner pattern for detecting the image density fluctuation is formed of a plurality of toner patches, each of the plurality of toner patches being formed with a same amount of toner.

9. The image forming apparatus as claimed in claim 1, wherein the image forming unit further comprises:

a charger to charge the image carrier;

an exposure unit to expose a charged surface of the image carrier corresponding to the image data;

a developing device to develop a latent image formed on the image carrier by exposure of light with toner on the developer carrier; and a transfer device to transfer the toner image formed on the image carrier by development to a transfer target member, wherein the image forming condition includes at least one of a charging condition, a development condition, an exposure condition, and a transfer condition in the image forming unit.

10. The image forming apparatus as claimed in claim 1, further comprising a rotary position sensor to detect a rotary position of a rotary member, wherein the image forming controller performs said image forming processing using the image forming condition determined by the image forming condition determination controller in synchronization with a rotation position of the rotary member detected by the rotary position sensor.

11. The image forming apparatus as claimed in claim 1, further comprising a rotary position sensor, wherein the image forming condition determination controller determines whether or not the predetermined control termination condition is satisfied when a rotary position detected by the rotary position sensor changes by more than a predetermined threshold amount.

12. The image forming apparatus as claimed in claim 1, wherein the image forming condition determination controller determines whether or not the predetermined control termination condition is satisfied upon installation of a rotary member in the apparatus.

13. The image forming apparatus as claimed in claim 1, further comprising an environmental information detector to detect environmental information including at least temperature, wherein the image forming condition determination controller determines whether or not the predetermined control termination condition is satisfied when the environmental information detected by the environmental information detector changes by more than a predetermined threshold amount.

14. The image forming apparatus as claimed in claim 6, wherein the variation indices include a first variation index of amplitude data and a second variation index of phase data.

15. The image forming apparatus as claimed in claim 14, wherein if both the first variation index and the second variation index are below respective thresholds, said image forming condition determination processing to correct the image forming condition is performed using the image density fluctuation data.

16. The image forming apparatus as claimed in claim 14, wherein if either the first variation index or the second variation index exceeds a respective threshold, said image forming condition determination processing is stopped.

* * * * *